US009332866B1

(12) United States Patent
Konrath

(10) Patent No.: US 9,332,866 B1
(45) Date of Patent: May 10, 2016

(54) COMBINATION STORAGE AND DISPLAY SYSTEM

(71) Applicant: Roy G. Konrath, Germantown, WI (US)

(72) Inventor: Roy G. Konrath, Germantown, WI (US)

( * ) Notice: Subject to any disclaimer, the term of this patent is extended or adjusted under 35 U.S.C. 154(b) by 0 days.

(21) Appl. No.: 13/896,274

(22) Filed: May 16, 2013

Related U.S. Application Data

(60) Provisional application No. 61/648,747, filed on May 18, 2012.

(51) Int. Cl.
*A47F 7/30* (2006.01)

(52) U.S. Cl.
CPC ..... *A47F 7/30* (2013.01)

(58) Field of Classification Search
CPC ..... A47F 7/30
USPC ..... 211/17–22, 27–28, 5, 41.14, 41.15, 211/41.16, 126.15, 151, 162; 312/323, 312/334.14, 334.15; 206/326, 448, 449, 206/454; 5/146, 136; 414/277
See application file for complete search history.

(56) References Cited

U.S. PATENT DOCUMENTS 682,004 A * 9/1901 Tucker ..... 312/302
951,081 A 3/1910 Kennett
955,586 A 4/1910 Emerich
991,771 A 5/1911 Douglass
1,257,611 A 2/1918 Kelly
1,330,658 A 2/1920 Snyder
1,340,735 A * 5/1920 Page ..... 5/312
1,367,051 A 2/1921 James
1,456,988 A 5/1923 McAllaster
1,625,544 A * 4/1927 Jensen ..... 211/27
1,626,282 A * 4/1927 Jennings ..... 211/28
1,785,865 A * 12/1930 House ..... 5/147
1,866,853 A * 7/1932 Kennedy ..... 312/334.15
2,029,407 A * 2/1936 Blumental ..... 211/28
2,076,848 A * 4/1937 Keiver ..... 211/28
2,107,576 A * 2/1938 McAnally, Sr. ..... 211/28
2,167,198 A * 7/1939 Brownstein ..... 211/28
2,348,398 A * 5/1944 Lorey et al. ..... 211/28
2,788,528 A * 4/1957 Hansen ..... 5/6
3,185,306 A * 5/1965 Delaney ..... 211/28
4,553,278 A 11/1985 Drexhage
4,615,449 A 10/1986 Naito et al.
4,625,874 A 12/1986 Abe et al.
4,678,085 A * 7/1987 Sando ..... 211/28
5,226,714 A 7/1993 Wright
5,375,959 A * 12/1994 Trento ..... 414/277
5,913,271 A 6/1999 Lloyd (Continued)

FOREIGN PATENT DOCUMENTS

DE 3608343 C1 * 10/1987 ..... A47F 7/30

*Primary Examiner* — Joshua Rodden
(74) *Attorney, Agent, or Firm* — Brannen Law Office, LLC

(57) ABSTRACT

The present invention relates to a combination storage and display system, and in particular to a system that is modular, provides high density storage and easy display of mattresses. In one embodiment, the rack has a base frame with several longitudinal rails. Several display frames are also provided (one for each longitudinal rail). The display frames have a translating bar that is movable relative the longitudinal rails. The display frame has a post and an angled support. The angled support holds the mattress in a nearly vertical orientation. A mattress support is pivotally connected to the post. The mattress support has a base, two ears, a leg and a lip. The lip engages a small portion of a side of the mattress. The leg pivotally depends from an ear.

3 Claims, 26 Drawing Sheets

(56) References Cited

U.S. PATENT DOCUMENTS

| | | | | |
|---|---|---|---|---|
| 6,336,562 | B1 | 1/2002 | Mori | |
| 7,621,576 | B2 | 11/2009 | Cote | |
| 7,793,366 | B2 * | 9/2010 | Stoltzfus | 5/136 |
| 7,865,984 | B2 * | 1/2011 | Merritt | 5/503.1 |
| 2009/0212174 | A1 * | 8/2009 | Pratt et al. | 248/96 |
| 2012/0060279 | A1 * | 3/2012 | Colombo | 5/167 |

* cited by examiner

COMBINATION STORAGE AND DISPLAY SYSTEM

This United States utility patent application claims priority on and the benefit of provisional application 61/648,747 filed May 18, 2012, the entire contents of which are hereby incorporated herein by reference.

BACKGROUND OF THE INVENTION

1. Field of the Invention

The present invention relates to a combination storage and display system, and in particular to a system that is modular, provides high density storage and easy display of mattresses.

2. Description of the Related Art

It is typical for mattresses to be displayed at the retail level in order to allow a potential purchaser to observe and try-out the mattresses. One obstacle in displaying mattresses is the amount of square feet a display occupies. In this regard, there is limited floor space and retailers typically desire to increase the number of displays per square foot.

Several racks or displays have been developed over the years. Some examples include:

U.S. Pat. No. 682,004 to Tucker is titled Sectional Display Rack. This patent illustrates a rack for mattresses and pillows.

U.S. Pat. No. 3,185,306 to Delaney is titled Mattress Display Rack. It shows a rack used to display mattresses and the like.

U.S. Pat. No. 2,348,398 to Lorey is titled Rack. It shows a device for storing large articles such as mattresses.

U.S. Pat. No. 4,553,085 to Drexhage is titled Tip-Up Bed and Post Tensioned Bedding Retainer. It shows a pillow and bedding retainer for a made-up tip-up bed includes a flexible concave panel extending across a bed storage recess. The panel is freely mounted in a parallel spaced pair of horizontal open channels attached to a pivot frame forming a bedding cavity. As the bed is tilted from a horizontal position to a vertical position through an intermediate position the upper edge of the head of a mattress slidingly engages and presses the panel rearwardly further into the storage recess and tensions the pillow and upper bedding portions against the mattress head top surface retaining them in a diminishing volume of the cavity. The center of curvature of the panel is displaced from the pivot axis of the bed and the panel has a radius of curvature greater than the radius of curvature of the bed pivot axis.

U.S. Pat. No. 4,678,085 to Sando is titled Apparatus for the Display and Storage of Mattresses. It teaches an apparatus for the display and storage of mattresses, especially one which utilizes available space to optimum advantage, minimizes storage space, and facilitates ready removal of mattress from storage for display. The apparatus is constituted generally of a housing, inclusive of floor frame, supports, and ceiling frame providing mattress display and storage areas. Mattress display and storage carriages are suspended from and mounted on overhead tracks affixed to the ceiling, these traversing both the storage and display areas. Mattresses contained within said mattress display and storage carriages can be stored in tandem within the storage area to minimize storage space, independently transported into the display area, and mattresses unloaded for display. Suitably, a floor-attached rail within the storage area provides a ready and convenient means for the transport of a box spring upon which mattresses can be discharged from the display and storage carriages and laid out for viewing.

While these inventions may work well for their intended purposes, none show the unique aspects of the present invention.

For example, none show a combination storage and display unit that has a two sided entry, that is free from obstructions from above and that has a small lip that maintains the mattress orientation as the mattress support assembly rotates relative the translating bar.

Additionally, none show a combination of a pivotal leg and a pivoting leg support wherein the mattress height is determined by the respective pivots, yet, the mattresses are held in a high density arrangement.

Further, none show a combination storage and display system that stores mattresses on an angled plane relative the floor, whereby they are stable rotationally, yet easily pivotal to a display orientation that is parallel to the floor.

Thus there exists a need for a combination storage and display system that solves these and other problems.

SUMMARY OF THE INVENTION

The present invention relates to a combination storage and display system, and in particular to a system that is modular, provides high density storage and easy display of mattresses. In one embodiment, the rack has a base frame with several longitudinal rails. Several display frames are also provided (one for each longitudinal rail). The display frames have a translating bar that is movable relative the longitudinal rails. The display frame has a post and an angled support. The angled support holds the mattress in a nearly vertical orientation. A mattress support is pivotally connected to the post. The mattress support has a base, two ears, a leg and a lip. The lip engages a small portion of a side of the mattress. The leg pivotally depends from an ear. Several advantages, some of which are highlighted below, are apparent.

According to one advantage of the present invention, a combination storage and display unit is provided having two sided entry and exit, that is free from obstructions from above and that has a small lip (lower mattress support) that maintains the mattress orientation as the mattress support assembly rotates relative the translating bar.

According to another advantage of the present invention, the rack has a combination of a pivotal leg and a pivoting leg support wherein the mattress height is determined by the respective pivots, yet, the mattresses are storable in a high density arrangement.

According to a still further advantage of the present invention, the rack is a storage and display system that stores mattresses on an angled plane relative the floor in a near vertical orientation, whereby they are stable rotationally, yet easily pivotal to a display orientation that is parallel to the floor.

Related, and according to a further advantage of the present invention, a mechanical assist can be provided to help the user move a mattress support assembly from an angled extended position to a display position, and vice versa. The assist aids in raising and lowering of the display frame to make it easier for the user. In one embodiment, the mechanical assist can be a gas shock.

According to a still further advantage yet of the present invention, the rack is portable and can be disassembled.

According to a still further advantage yet of the present invention, an improved roller assembly is provided allowing for smooth operation of the invention being moved between the extended and storage position.

According to a still further advantage of the present invention, in one embodiment, one or more clamps can be provided to secure a mattress to the mattress support frame.

According to a still further advantage yet of the present invention, a leg stabilizer such as a magnet or cable can be provided to assist in ensuring the legs are fully deployed when the display frame is rotated towards the display position.

According to a still further advantage yet of the present invention, an angle adjuster such as a stop bolt is provided for allowing the angle of storage to be adjusted.

According to a still further advantage yet of the present invention, an anti-tipping device is provided. The anti-tipping device is useful when the display frame is retracted (prevent tipping), and out of the way when extended (allow tipping) relative the base frame.

According to a still further advantage of the present invention, it can be constructed for use with any style and size of mattress.

According to another advantage of the present invention, the display frames can be made to rotate both left and right relative the base frame. Advantageously, this allows for use against walls both directions relative the racks. The orientation can be changed by merely changing the brackets from one side to the other of the base frame.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
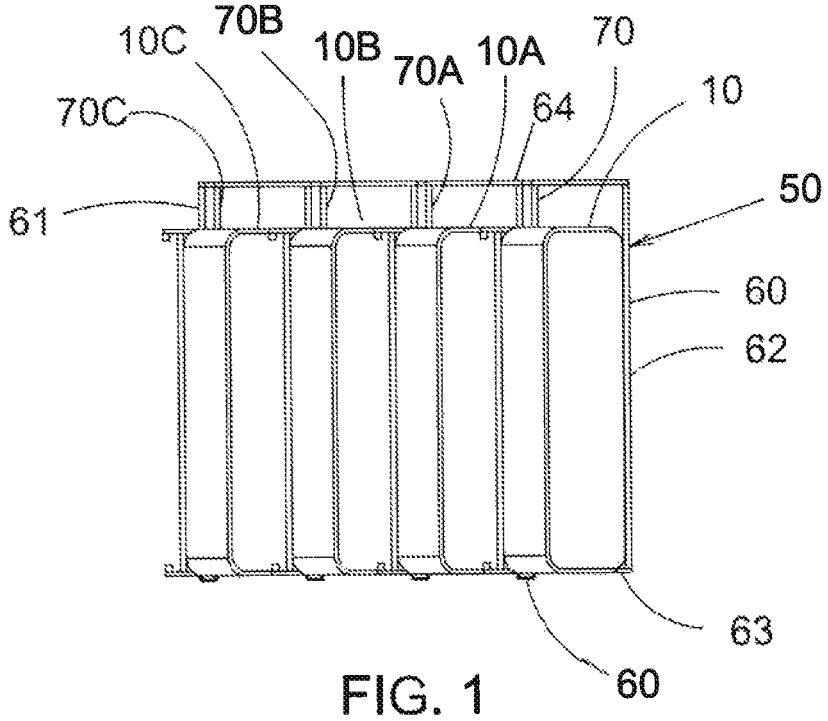
FIG. 1 is a top view of a preferred embodiment of the present invention shown in a storage position.
Figure 2:
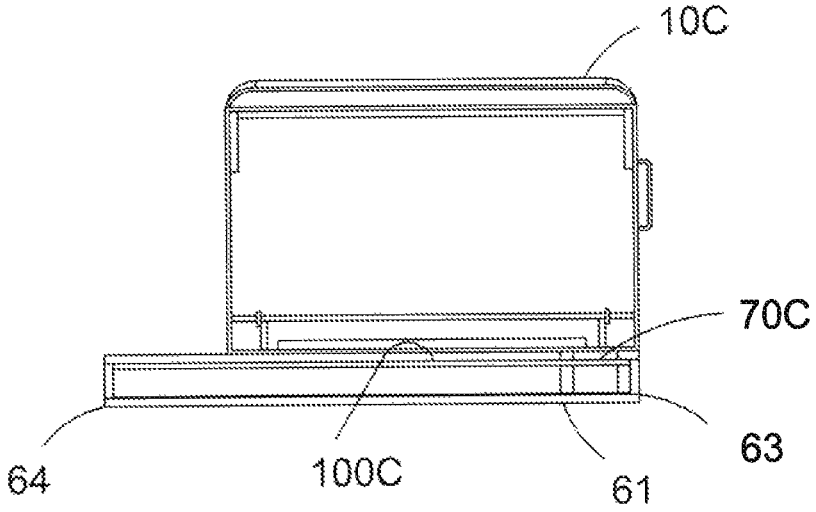
FIG. 2 is a side view of the embodiment shown in FIG. 1.
Figure 3:
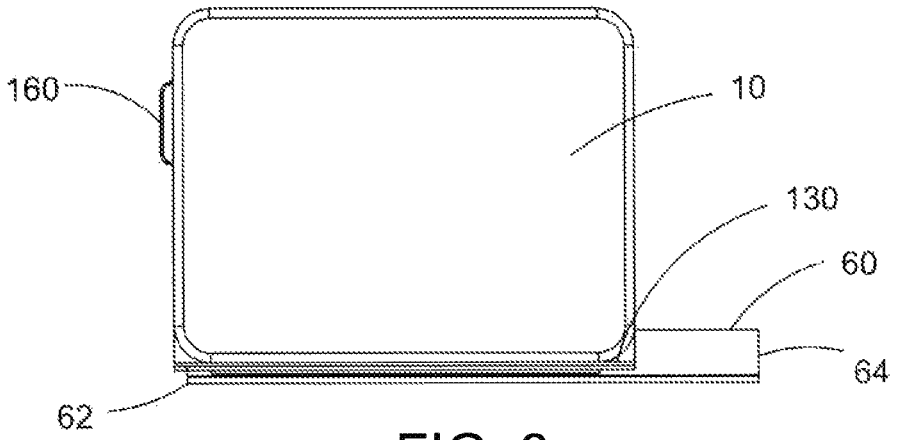
FIG. 3 is an opposite side view of the embodiment shown in FIG. 1.
Figure 4:
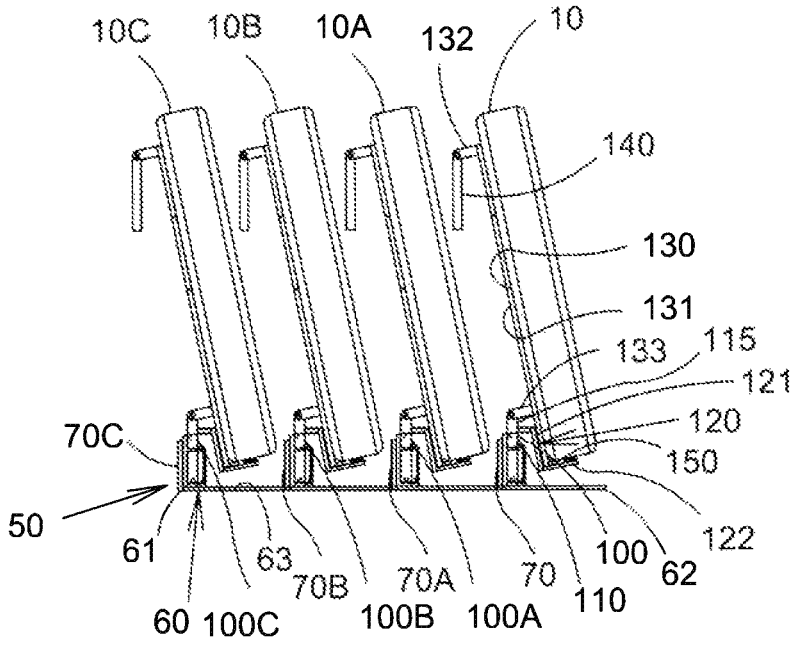
FIG. 4 is an end view of the embodiment shown in FIG. 1.
Figure 5:
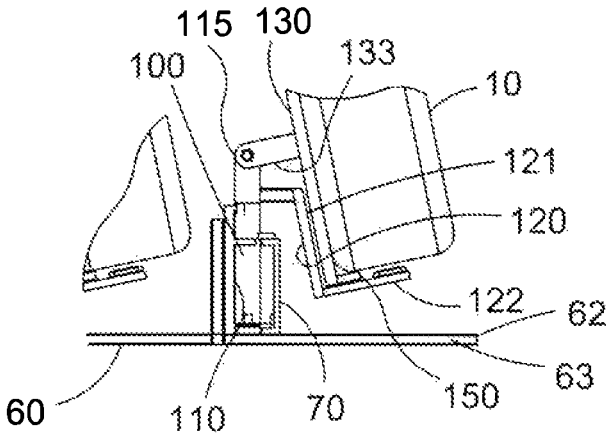
FIG. 5 is a close-up view of a selected portion of the embodiment shown in FIG. 1.
Figure 6:
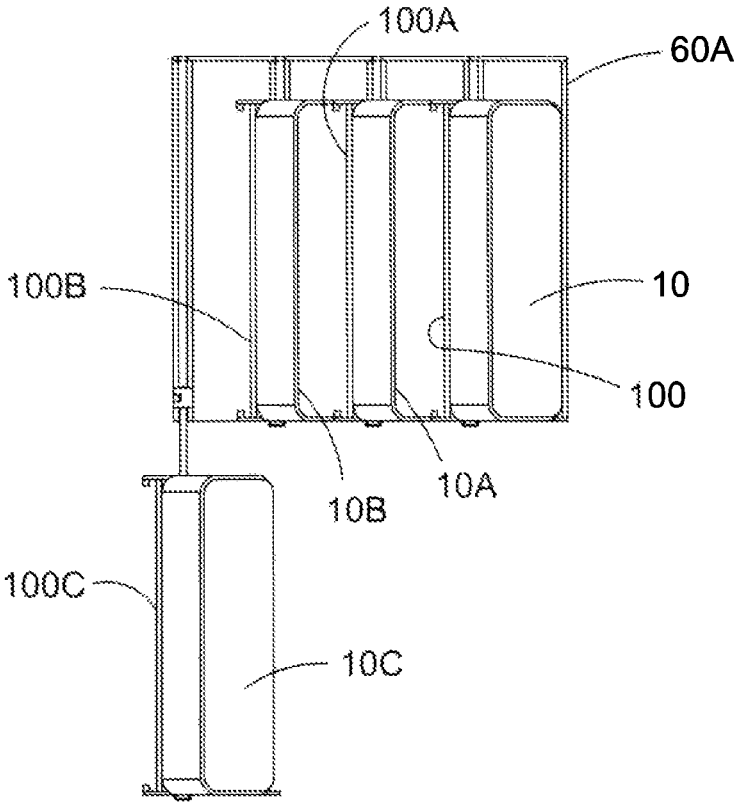
FIG. 6 is a top view similar to FIG. 1, but showing a mattress in an intermediate position.
Figure 7:
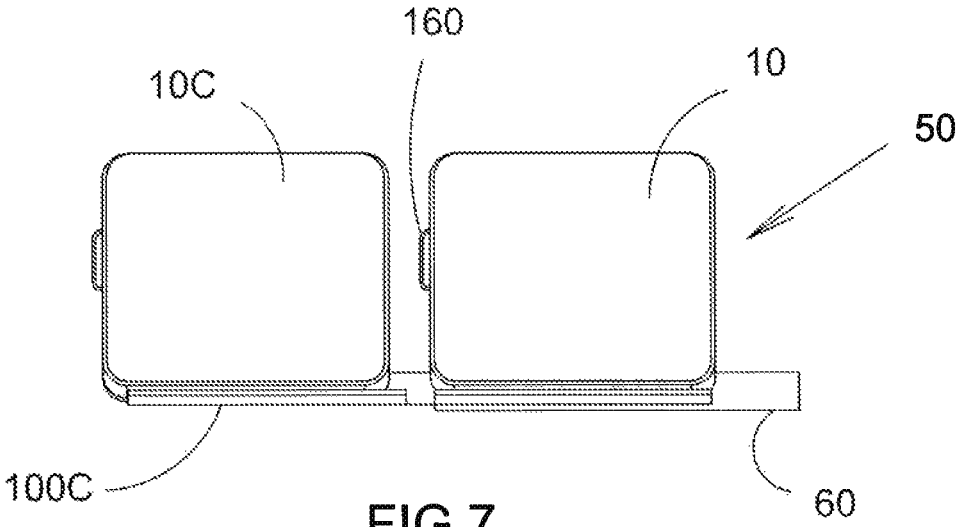
FIG. 7 is a side view of the view shown in FIG. 6
Figure 8:
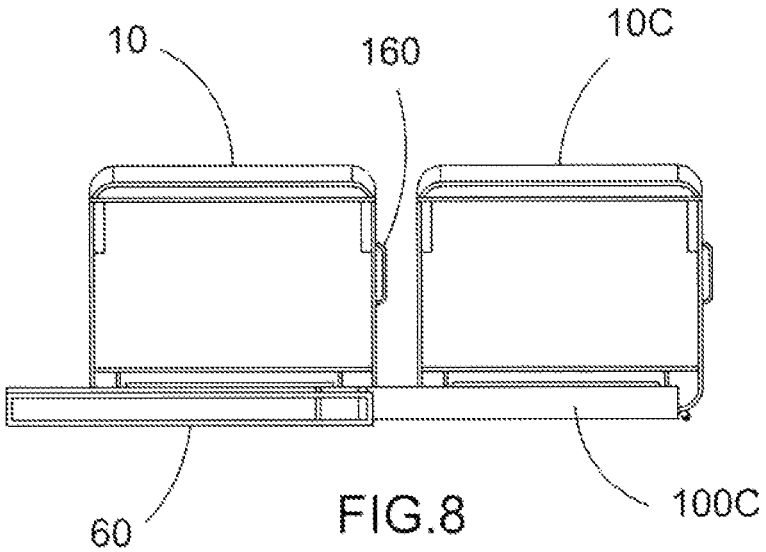
FIG. 8 is an opposite side view of the view shown in FIG. 6.
Figure 9:
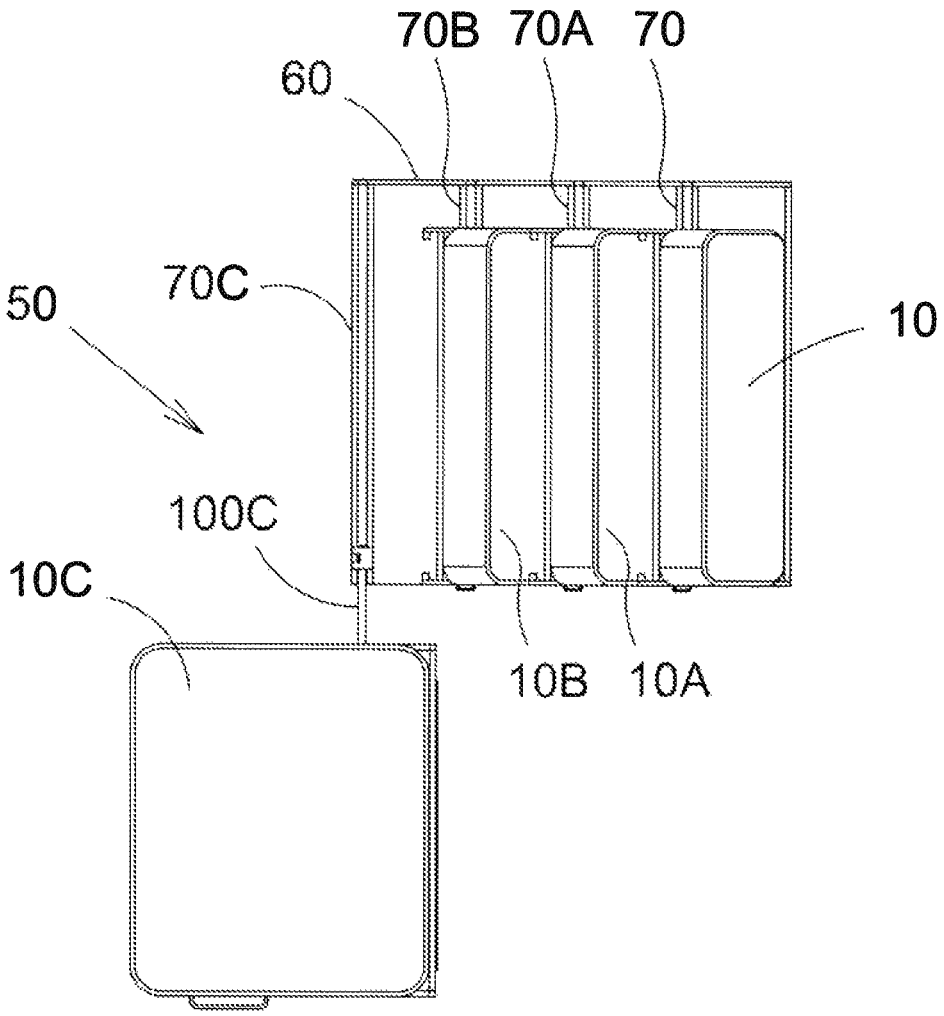
FIG. 9 is a top view similar to FIG. 6, but showing a mattress in a display position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-12, it is seen that a first preferred embodiment is illustrated. In this embodiment, it is seen that four mattresses 10, 10A, 10B and 10C can be selectively stored and displayed. It is appreciated that while four mattresses are shown, that a rack 50 for more or fewer mattresses could be used without departing from the broad aspects of the present invention. It is also understood that several racks 50 could be lined up side to side in order to create a longer display due to the modular nature of the present invention.

Rack 50 has a base frame 60 with at least one longitudinal rail 70 and at least one display frame 100. Each of these parts is preferably made of a strong and rigid material, such as metal. However, other materials could be used without departing from the broad aspects of the present invention.

Base frame 60 has sides 61 and 62, and ends 63 and 64. The base frame is preferably rectangular. It is preferred that four longitudinal rails 70, 70A, 70B and 70C spans across the base frame 60 between ends 63 and 64. The longitudinal rails are preferably stationary relative the base frame 60.

Four display frames 100, 100A, 100B and 100C are preferably provided. The display frames are each preferably identical to each other. Display frame 100 is described in detail. It is appreciated that the other frames are similar to frame 100.

Frame 100 has a translating bar 110. In a preferred embodiment, the translating bar 110 can have one or more rollers to affect lateral movement relative longitudinal rail 70. While a roller is preferred, it is understood that other movable relationships can be used without departing from the broad aspects of the present invention. The display frame 100 further has a post 115.

An angled support 120 having a first piece 121 and a second piece 122 are provided. The first and second pieces are preferably generally perpendicular to each other. The first piece 121 is angled with respect to vertical preferably about 5-15 degrees. However, this angle could be greater or smaller without departing from the broad aspects of the present invention. The angled support 120 is preferably fixed in position relative the translating bar 110. The angled support 120 supports mattress 10 when the mattress 10 is in the storage position. In this regard, the mattress is held in a near vertical orientation upon the angled support 120. Yet, it is appreciated that no straps are necessary to hold the mattress in place due to the angled storage orientation. Hence, when in the display orientation, there are no straps to remove in order to test the mattress.

A mattress support assembly 130 is further provided. The mattress support assembly 130 has a base 131. The base 131 directly contacts the mattress 10. Ears 132 and 133 are provided. Ear 133 allows the mattress support assembly to be pivotally connected to the post 115. Ear 132 is pivotally connected to a leg 140. The leg freely rotates relative ear 132 under the force of gravity. In this regard, when in the storage position, the leg is pivoted to a storage position. However, the legs are in the deployed position (generally perpendicular to the mattress) when the mattress is displayed.

A lip 150 (lower end mattress support) is further provided. The lip 150 is preferably relatively small in height relative the mattress. The lip 150 supports the mattress while it is being moved from the storage or intermediate positions to the display position. The lip 150 prevents the mattress 10 from sliding or moving off from the display frame 100. It is appreciated that the lip in unobtrusive to a potential purchaser. In this regard, the lip does not inhibit the ability of the potential purchaser to enter or exit from either side of the bed. The lip preferably spans the dimension of the mattress (side or end). However, the lip could alternatively be comprised of several discrete segments without departing from the broad aspects of the present invention.

Further, since there are no straps used to hold the mattress in a storage position, there are likewise no straps to remove in order to test the mattress when it is in a display orientation.

The location of the pivots determines the height upon which the mattress 10 sits off from the ground. The legs preferably fall via gravity. However, a spring assist or a mechanical positioner could be used without departing from the broad aspects of the present invention.

Figure 10:
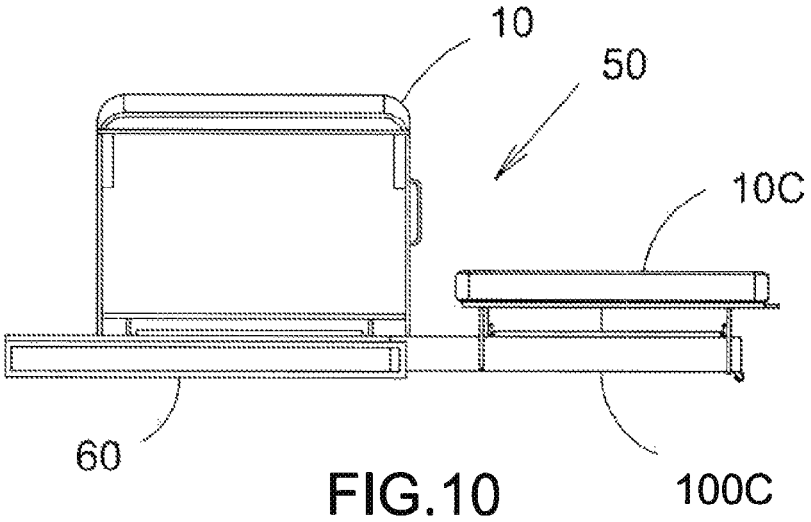
FIG. 10 is a side view of the view shown in FIG. 9.
Figure 11:
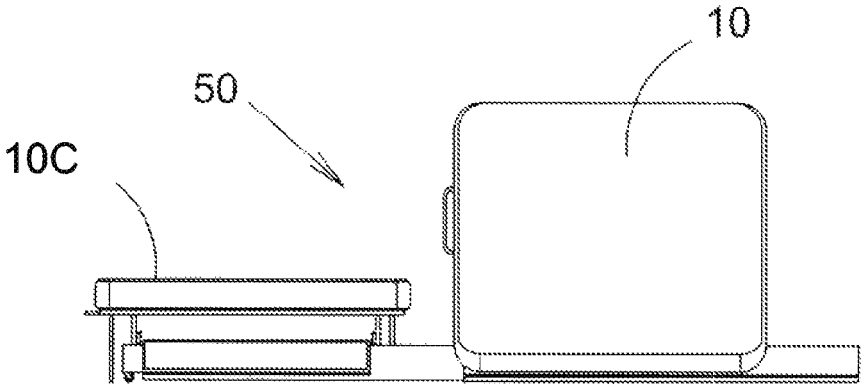
FIG. 11 is an opposite side view of the view shown in FIG. 9.
Figure 12:
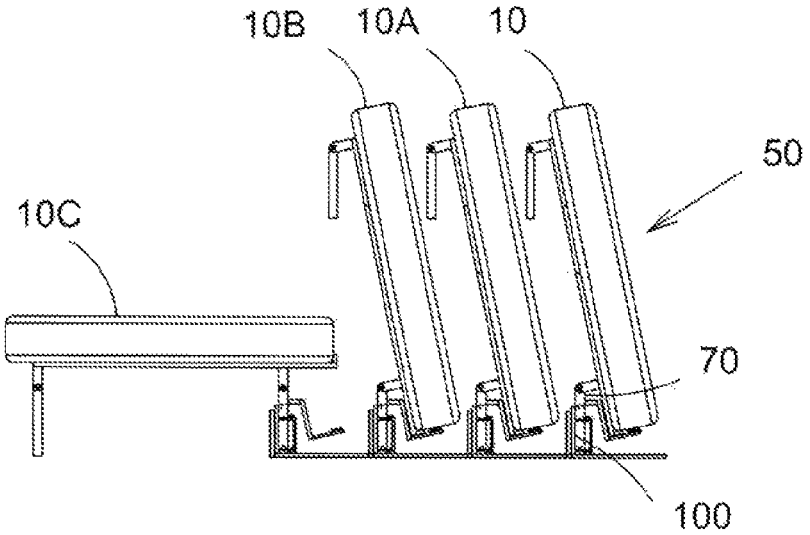
FIG. 12 is an end view of the view shown in FIG. 9.
Figure 13:
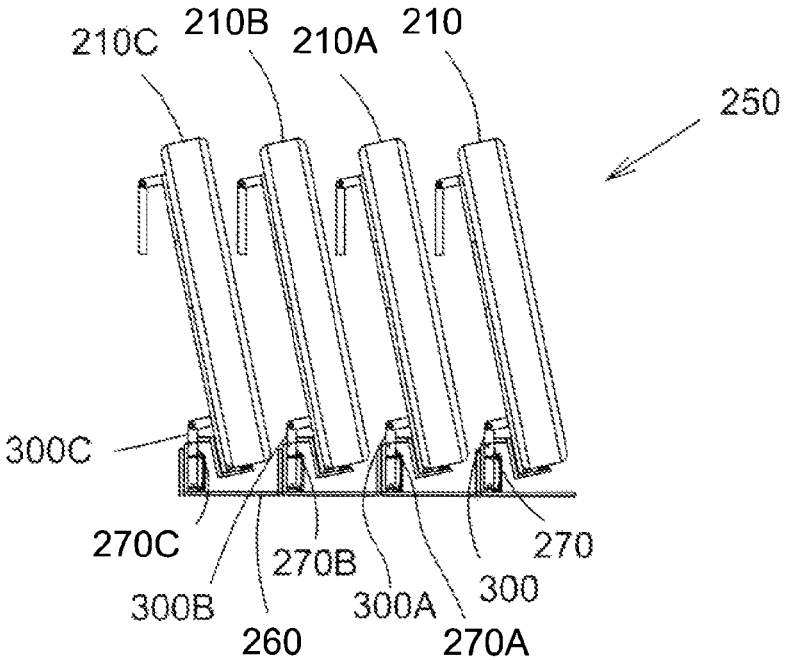
FIG. 13 is an end view of an alternative embodiment of the present invention shown in a storage position.
Figure 14:
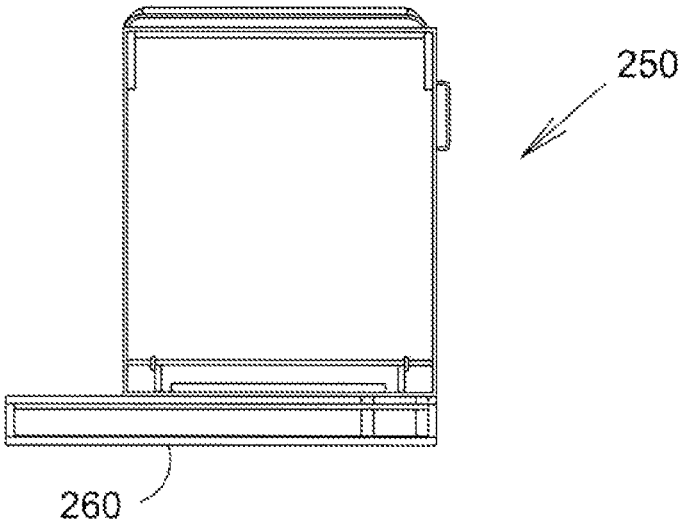
FIG. 14 is a side view of the view shown in FIG. 13.
Figure 15:
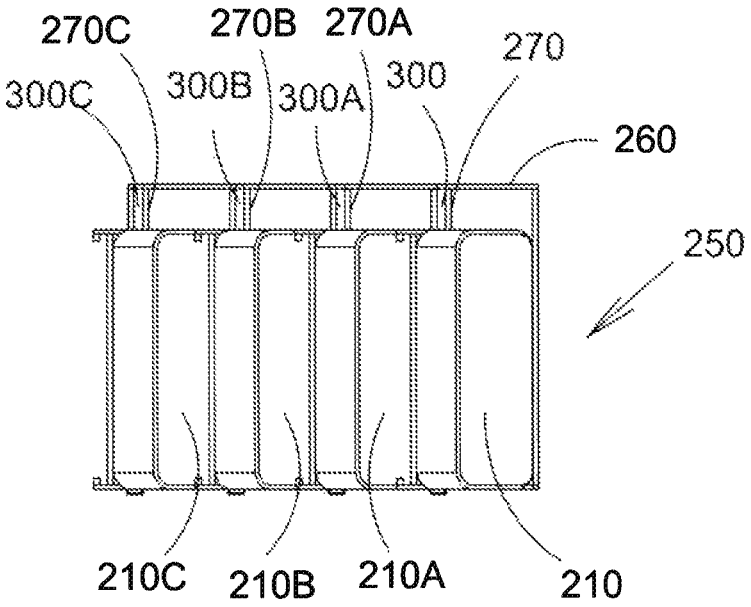
FIG. 15 is a top view of the view shown in FIG. 13.
Figure 16:
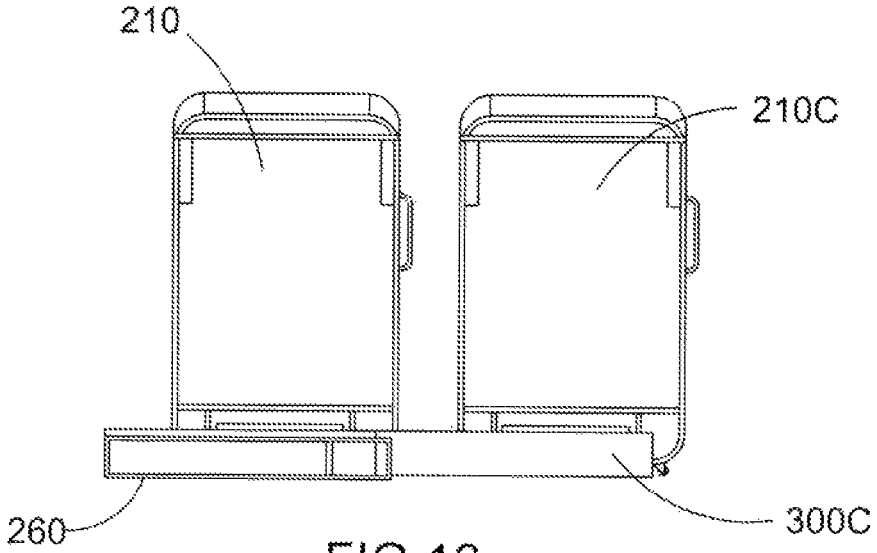
FIG. 16 is a side view of the embodiment shown in FIG. 13 in an intermediate position.
Figure 17:
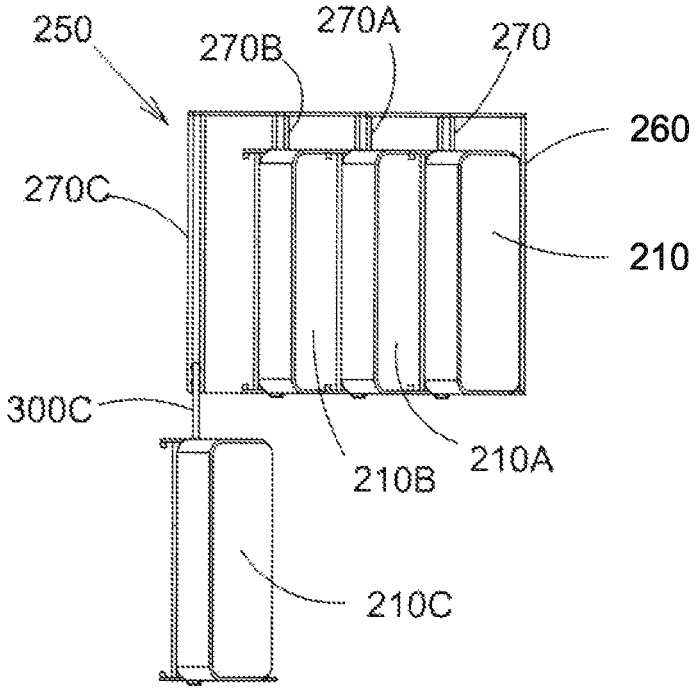
FIG. 17 is a top view of the view shown in FIG. 16.
Figure 18:
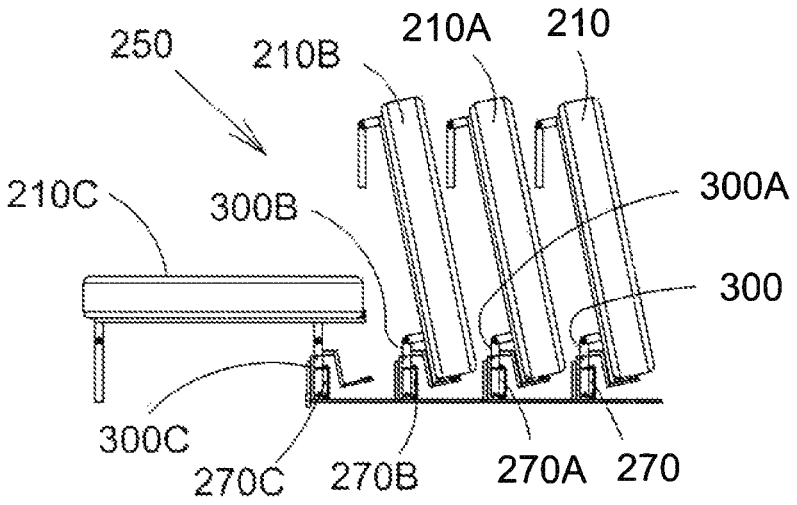
FIG. 18 is an end view of the embodiment shown in FIG. 13, but show in a display position.
Figure 19:
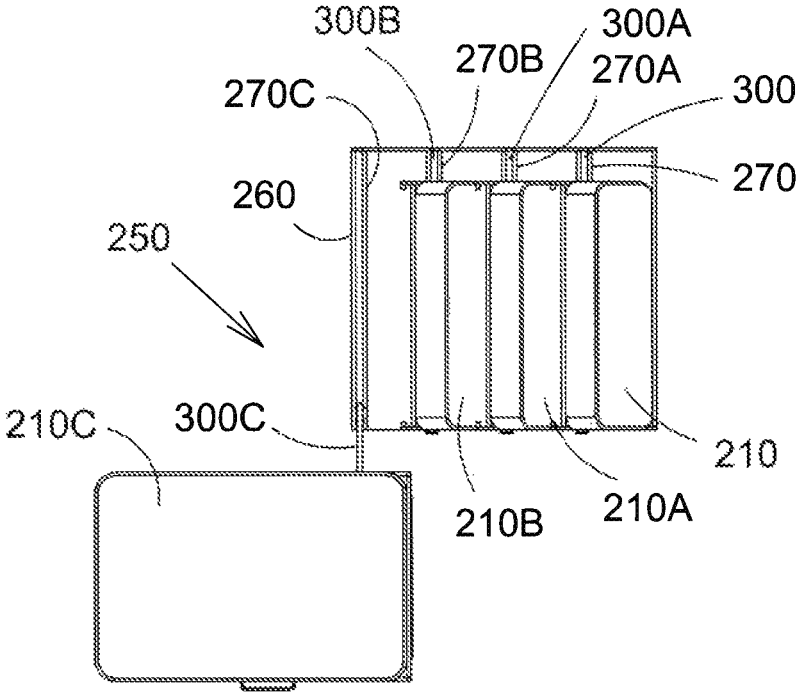
FIG. 19 is a top view of the embodiment shown in FIG. 13.

It is understood, when looking specifically at FIGS. 10-12, that the full support for the mattress is provided from below the mattress. In this regard, the potential purchaser has the ability to have two sided entry without obstructions from above the mattress.

It is further appreciated that the angled support 120 projects out only a minimal amount beyond the side of the mattress when in the display position. It is understood that the location of the pivots could be altered so that the angled support 120 is fully below the mattress when in the display position. Still further, it is understood that piece 122 could pivot relative piece 121, wherein piece 122 can be pivoted upwards and out of the way of a user.

To move from the storage position to a display position, the mattress is moved laterally out from the rack 50. Then the mattress is pivoted so that the mattress is parallel with the ground in the display position. A spring or other assist mechanism can be used to guide the mattress in the pivot from the intermediate position to the display position, and then back from the display position to the intermediate position.

Turning now to FIGS. 13-19, it is seen that an alternative embodiment of the present invention is illustrated. Four mattresses 210, 210A, 210B and 210C are shown held in a rack 250. The rack 250 had a base frame 260 with longitudinal rails 270, 270A, 270B and 270C. Display frames 300, 300A, 300B and 300C are also provided. These parts operate similar to rack 50. However, the orientation of the displayed mattresses is altered as seen in the drawings. In this regard, the mattresses are moved out from the base frame 260 a selected amount so that the mattresses remain accessible from both sides.

From the foregoing, it is seen that all mattress sizes can be stored and displayed from a stand on end position or from a stand on side position. In this regard, the user can configure the racks in a way to suit their needs.

It is also appreciated that the display height can be adjusted by adjusting the locations of the ears relative the display support. It is understood that the length of the leg is preferably matched to the distance between the pivot of the opposite ear and floor so that the mattress is flat in the display position.

The rack can be configured to accommodate mattresses between 6 and 18 inches in thickness (and can be greater or smaller without departing from the broad aspects of the present invention). This can be accomplished by either having factory mounted rails a selected off-set distances, or by having the longitudinal rails be adjustable by the user.

It is appreciated that while the present invention has been illustrated in tip-left orientations, that the tipping orientations can be reversed (to tip-right) without departing from the broad aspects of the present invention.

According to another aspect of the present invention, a lock can be provided for preventing the displays from inadvertently moving from the storage position. The lock can be, for example, a user manipulated toggle or lever release.

According to a still further aspect of the present invention, the invention can be housed in an external shell to enhance the appearance of the display.

Turning now to FIGS. 20-28, it is seen that an additional alternative embodiment of the present invention is illustrated.

A display rack 450 is provided for displaying mattresses 410 and 410A. It is appreciated that while the rack 450 is shown for use with two mattresses, that it can be configured for more or fewer mattresses without departing from the broad aspects of the present invention. The present invention is also modular, and can be arranged side by side to form an elongated display.

The display rack 450 has a base frame 460. The base frame 460 has two opposed sides 461 and 462, as well as two opposed sides or ends 463 and 464. The base frame 460 is generally rectangular in shape.

A longitudinal rail 470 is provided on the base frame 460. The rail 470 spans between the front end 463 and back end 464. Rail 470 is preferably tubular, and has a top 472, a bottom 473, a side 474 with a guide 475 and a second side 476 with a guide 477. The guides are preferably formed of extending portions of the rail outwards along the rail sides. The guides are preferably generally parallel to each other, and each guide defines a protrusion along the longitudinal length of the rail 470.

A second longitudinal rail 480 is further provided. Rail 480 is generally parallel to and is preferably similar to rail 470.

A display frame 500 is further provided. The display frame 500 has a translating bar 510 that is movable relative rail 470. There are preferably four risers (520, 525, 530 and 535) connected to the translating bar 510. Each riser is preferably formed of a rectangular plate. Each riser is preferably generally parallel with each other. Riser 520 has a generally rectangular hole 521 there through. A roller 522 is supported by the riser 520 and passes through the hole 521. Roller 522 preferably has a top portion and a bottom portion. Riser 525 has a generally rectangular hole 526 there through. A roller 527 is supported by the riser 525 and passes through the hole 526. Roller 527 preferably has a top portion and a bottom portion. Riser 530 has a generally rectangular hole 531 there through. A roller 532 is supported by the riser 530 and passes through the hole 531. Roller 532 preferably has a top portion and a bottom portion. Riser 535 has a generally rectangular hole 536 there through. A roller 537 is supported by the riser 535 and passes through the hole 536. Roller 537 preferably has a top portion and a bottom portion.

Rollers 522 and 527 engage guide 477. Rollers 532 and 537 engage guide 475. The rollers engage the rail above and below the guides, and the guides act to maintain stability as the display frame is moved relative the base frame along the longitudinal rail.

A top roller 540 is further provided. Top roller preferably engages the top 472 of the rail 470. The rollers collectively allow for smooth lateral movement of the translating bar 510 relative the longitudinal rail 470 in a direction parallel to the longitudinal axis of the longitudinal rails.

Figure 28:
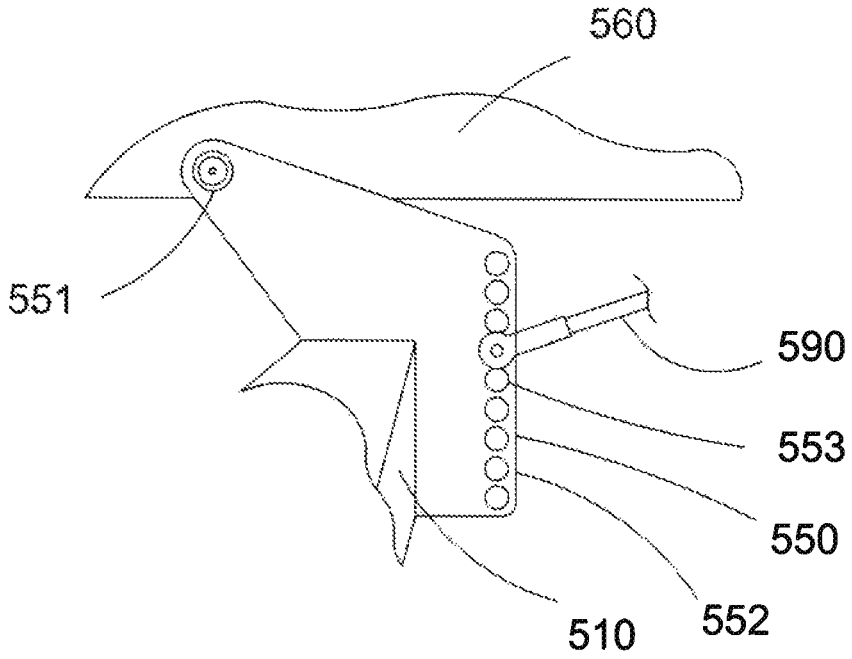
FIG. 28 is a close up perspective view showing a bracket of the embodiment shown in FIG. 20.

A bracket 550 or hinge is further provided. The bracket has a first end 551, a second end 552 and preferably one or more holes 553. In the illustrated embodiment, the bracket has a plurality of holes. Yet, more or fewer may be provided without departing from the broad aspects of the present invention. Bracket 550 is fixed to the translating bar 510. End 551 extends upwards from the translating bar 510, as seen in FIG. 28 a predetermined amount. A hole is at the end 551 of the bracket and defines an axis of rotation 555.

A second bracket 550A or hinge is further provided and is similar to bracket 550. This is best seen in FIG. 21A.

A mattress support assembly 560 is further provided. The support assembly 560 has ends 561 and 562 as well as sides 563 and 564. The sides can be formed from multiple pieces that are bolted or otherwise removably fastenable together.

The mattress support assembly has a base 570. A lip 571 is provided. In a preferred embodiment, the lip 571 surrounds the end 562 and the sides 563 and 564. In this regard, the lip 571 provides lower end mattress support to hold the mattress on the mattress support assembly especially when the mattress is stored in a storage position in an inclined or near vertical plane.

Figure 22:
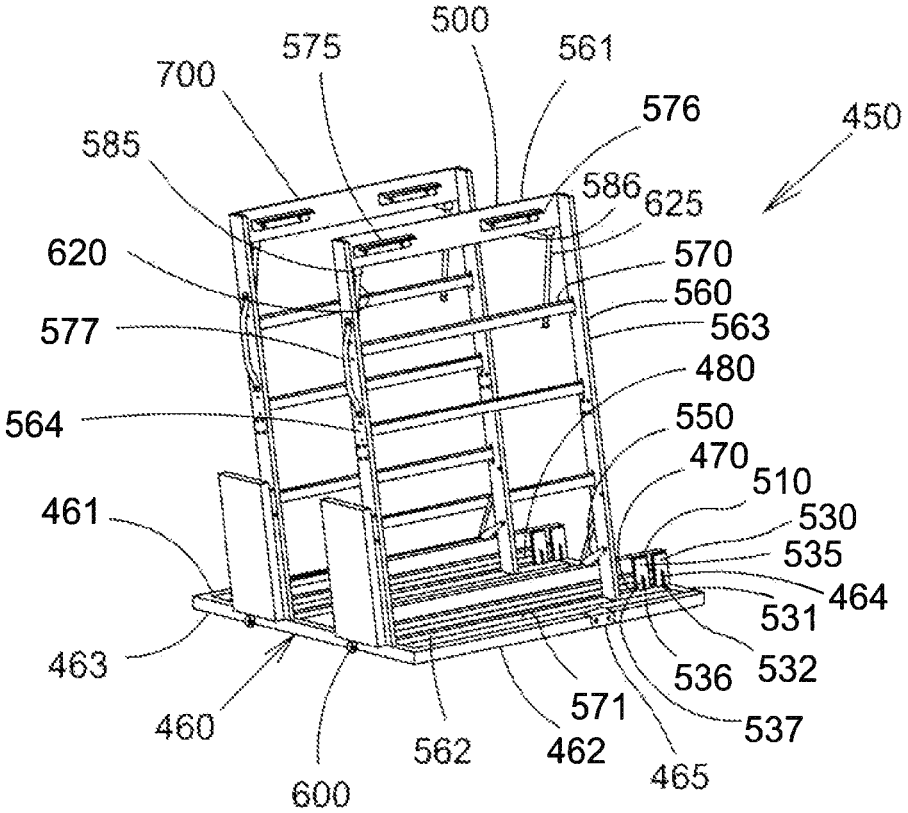
FIG. 22 is an alternative perspective view of the embodiment shown in FIG. 20.
Figure 23:
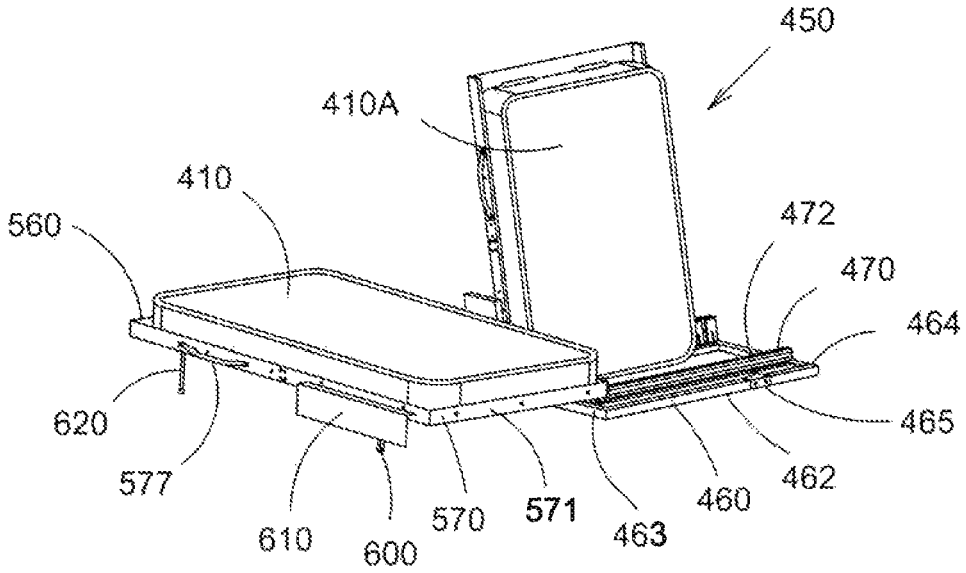
FIG. 23 is a perspective view showing one display frame in a display position.
Figure 23A:
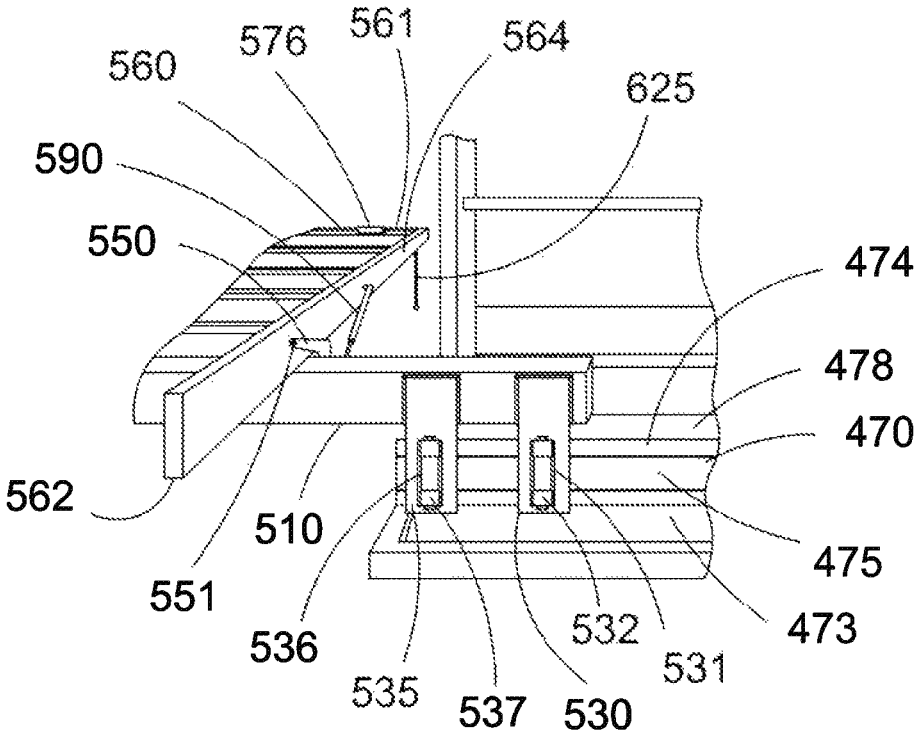
FIG. 23A is a close up perspective view of a selected portion of the embodiment shown in FIG. 20.
Figure 24:
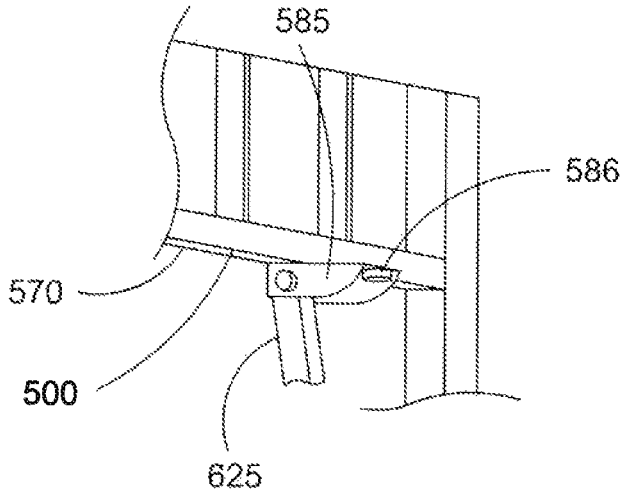
FIG. 24 is a close up perspective view of a leg assist within a bracket.
Figure 24A:
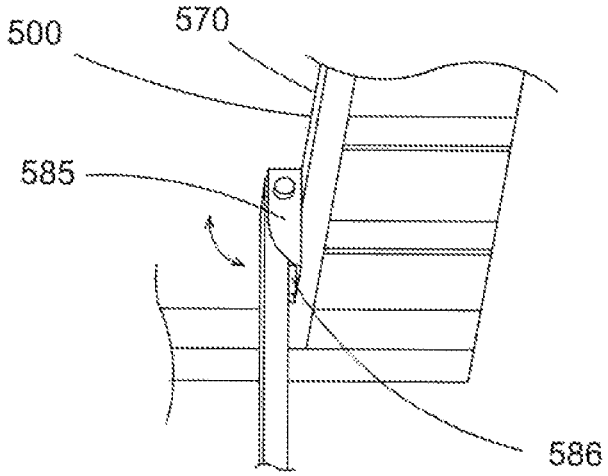
FIG. 24A is similar to FIG. 24, but shows the leg in the extended position adjacent the leg assist mechanism.
Figure 25:
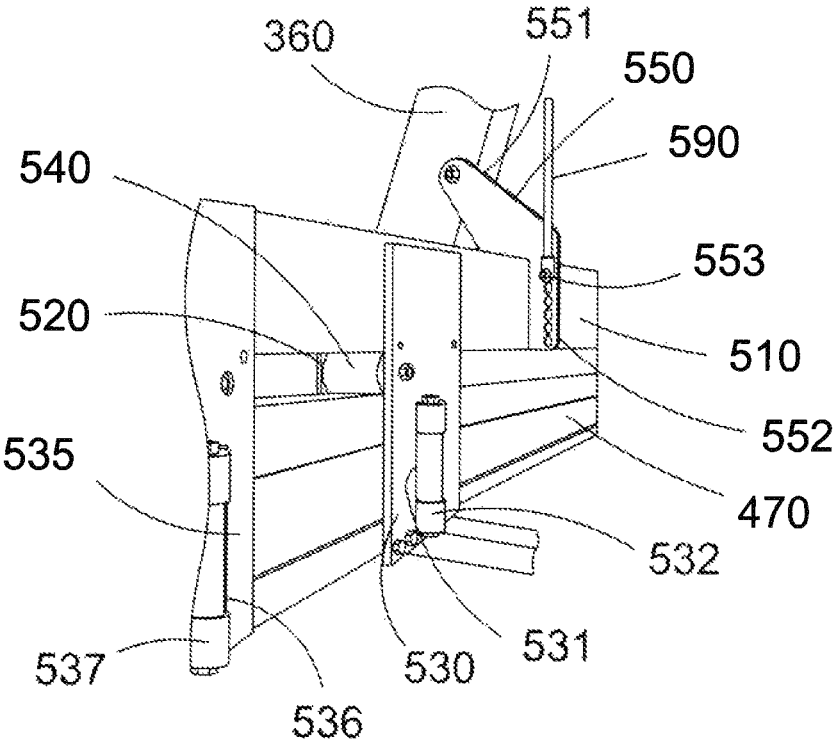
FIG. 25 is a close up perspective view of a selected portion of the embodiment shown in FIG. 20.
Figure 26:
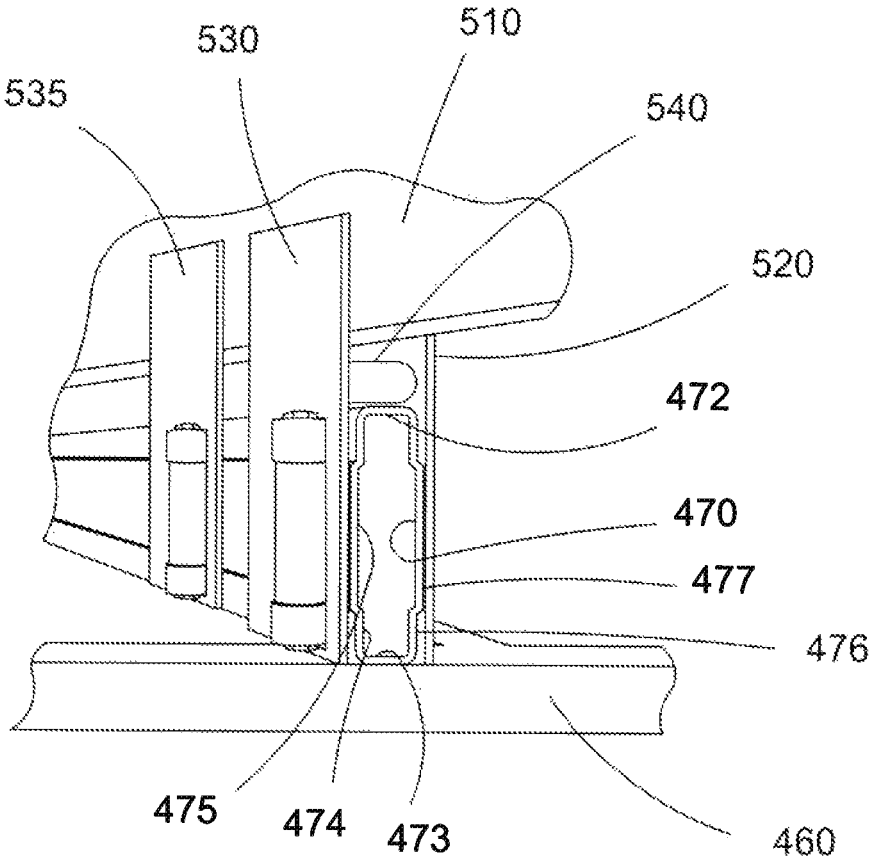
FIG. 26 is an end perspective view showing the longitudinal rail.

Two clamps 575 and 576, respectively, are further provided as best seen in FIGS. 22 and 23. Clamps preferably have a first portion that can be movably fixed to the base 570. This can be accomplished by providing a slot. A bolt can pass through the slot, and when tightened to the base, securely holds the clamp in the intended location. The clamps also have a second portion that is preferably generally perpendicular to the first portion. In this regard, the clamp second portion engages the outer wall of the mattress to provide enough compressive force to prevent the mattress from escaping the mattress support assembly when in an inclined position.

A handle 577 is provided on side 564 of the mattress support assembly 560. The handle 577 is used to pull the display frame 500 from a retracted position to an extended upright position, and then to move the display frame from an extended upright position to a display position.

A bracket 580 is used to connect leg 620 to the display frame 500. A leg deployment assist mechanism such as a magnet 581 can be provide to assist the leg is extending to the fully extended or deployed position as the display frame is rotated to the display position.

A second bracket 585 is used to connect leg 625 to the display frame 500. A leg deployment assist mechanism such as a magnet 586 can be provide to assist the leg is extending to the fully extended or deployed position as the display frame is rotated to the display position.

The leg deployment assist mechanisms (or simply leg assist mechanisms) aid in holding the legs in the fully deployed position when the rack is in the display position. Upon raising of the rack to the extended upright angled position, the weight of the legs becomes sufficient to overcome the gravitational force holding the legs generally perpendicular to the plane of the mattress support assembly. In this regard, the legs then can be generally vertical (via gravity) and be rotationally held in brackets by a bolt.

A mechanical assist 590 is further provided to aid in the lowering and raising of the display frame. The mechanical assist is preferably a gas piston or shock having one end connected to the bracket 550 and the second end connected to the mattress support assembly.

A second mechanical assist 590A is further provided and is similar to assist 590.

Figure 27:
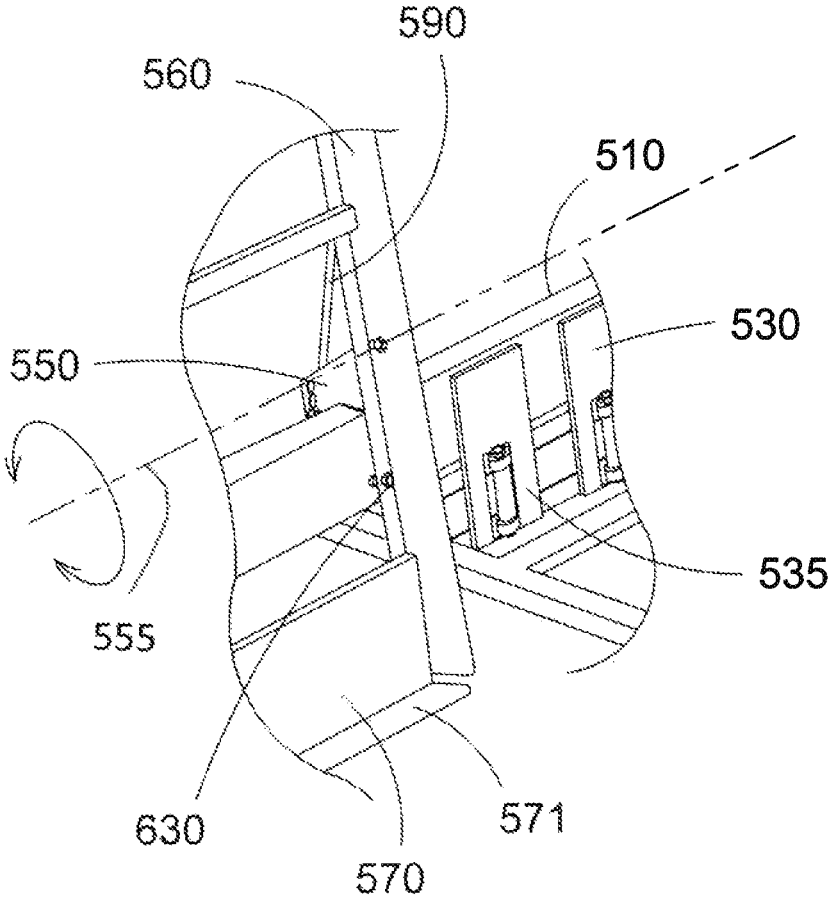
FIG. 27 is a close up perspective view showing an angle control device.

The mattress support assembly 560 is pivotally connected to brackets 550 and 550A. In this regard, the pivot point (as seen in FIG. 27) sets the height of the mattress support assembly when it is in the display position. The pivot point rotates about an axis of rotation 555 as seen in FIG. 27.

The distance between the axis of rotation 555 and the end of the mattress support assembly 560 (end with lip 571) is preferably less than the length of the legs.

When the mattress support assembly is rotated from the upright angled position to the display position about the axis of rotation 555, the mechanical assists 590 and 590A are extended. The assists 590 and 590A are retracted when the mattress support assembly is rotated form the display position to the upright or angled storage position.

Looking now at FIGS. 22 and 23, an anti-tipping device 465 can optionally be provided. The anti-tipping device 465 can be bolted to the base frame. The device 465 reduces clearance of the mattress support assembly 560 when it is fully retracted relative the base frame 460 so that the mattress support assembly 560 cannot rotate because of contact with the device 465. However, when the mattress support assembly 560 is extended relative the longitudinal rail 470 of the base frame 460, the mattress support assembly is free to rotate or pivot without contacting the device 465.

A castor or wheel 600 is further provided to aid in moving the display frame 500 relative the rail 470. The castor 600 is preferably located on the outside of the base frame both when the mattress support assembly is extended and fully retracted. The castor or wheel aids in moving the display frame A cover 610 or pinch protection plate is provided and covers the mechanical assist 590A and the bracket 550A at the remote end of the mattress support assembly 560. This is best seen in FIG. 21A.

It is appreciated that the height of the legs is preferably between 13 and 17 inches. In a more preferred embodiment, the legs are approximately 15.25 inches. In this regard, the leg height is preferably greater than the height that the brackets 550 and 550A extend above the translating bar. Legs are sized so that the mattress support assembly is flat relative the floor in the display position. The leg length may be greater than or smaller than the provided preferred range without departing from the broad aspects of the present invention.

Now turning specifically to FIG. 27, it is seen that an angle determination device 630 is provided. In the preferred embodiment, a stop bolt can be used to determine the angle of the mattress support assembly 560 is stored when in the upright angled position. In this regard, it is preferred that the upright angled position be in the range of 75-85 degrees. In the preferred embodiment, the angle (measured from horizontal) is preferably 80 degrees. However, the angle can be larger or smaller without departing from the broad aspects of the present invention. The bolt is preferably adjustable and can contact the translating bar 510 of the display frame. In the illustrated embodiment, the angle determination device accounts for approximately 5 degrees of angle (85 degrees from horizontal if the device is removed). In the preferred embodiment, there are two angle determination devices, one on each side of the mattress support assembly. It is further appreciated that while it is preferred to have at least a slight deviation from being vertical (slight angled plane) to prevent mattress tipping, that the mattress support assemblies could be stored completely vertically without departing from the broad aspects of the present invention.

Figure 20:
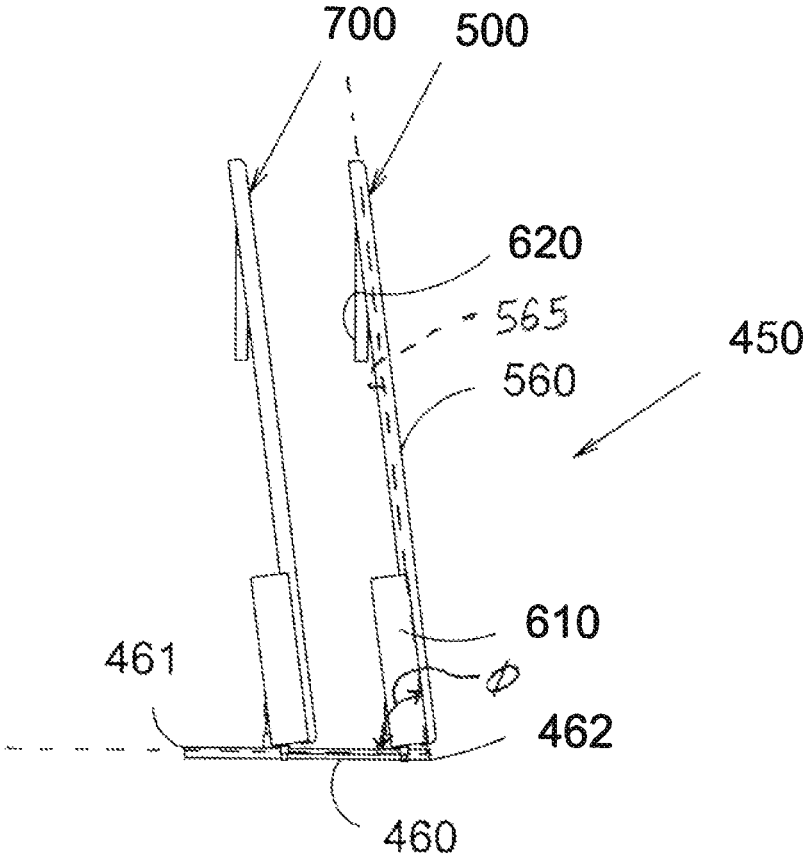
FIG. 20 is an end view of an alternative preferred embodiment of the present invention.
Figure 21:
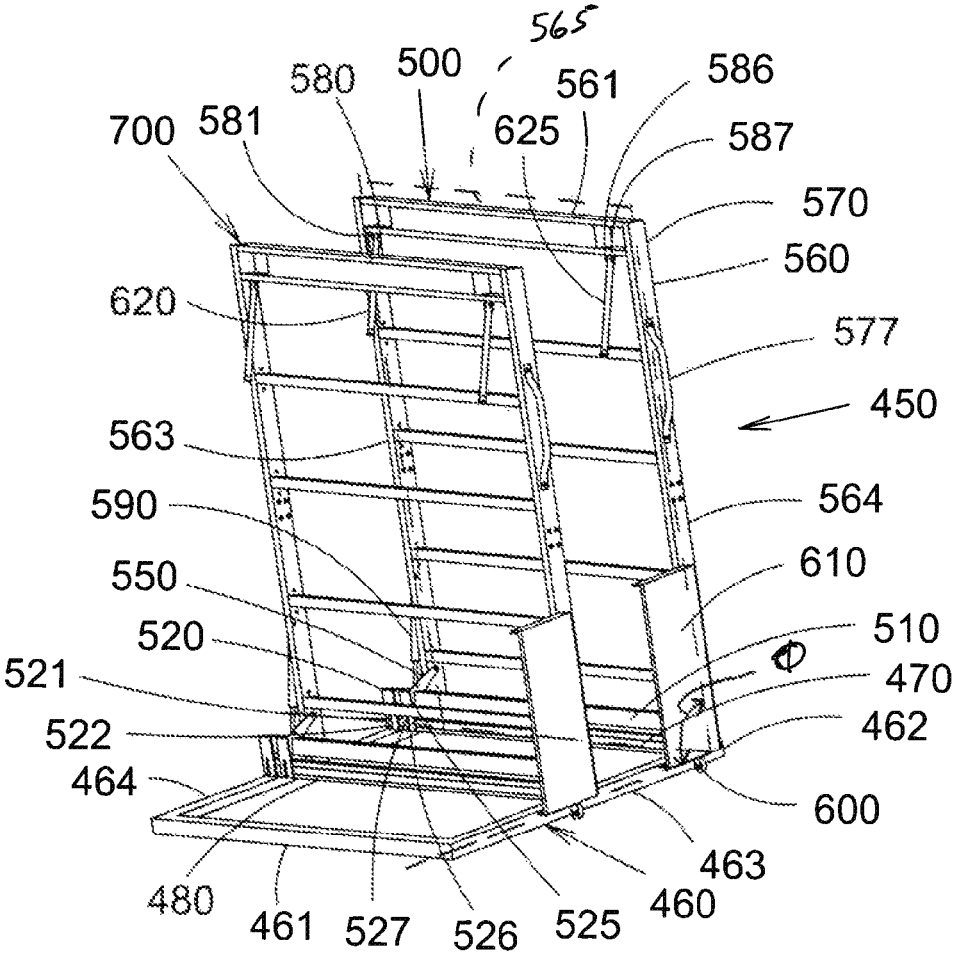
FIG. 21 is a perspective view of the embodiment shown in FIG. 20.
Figure 21A:
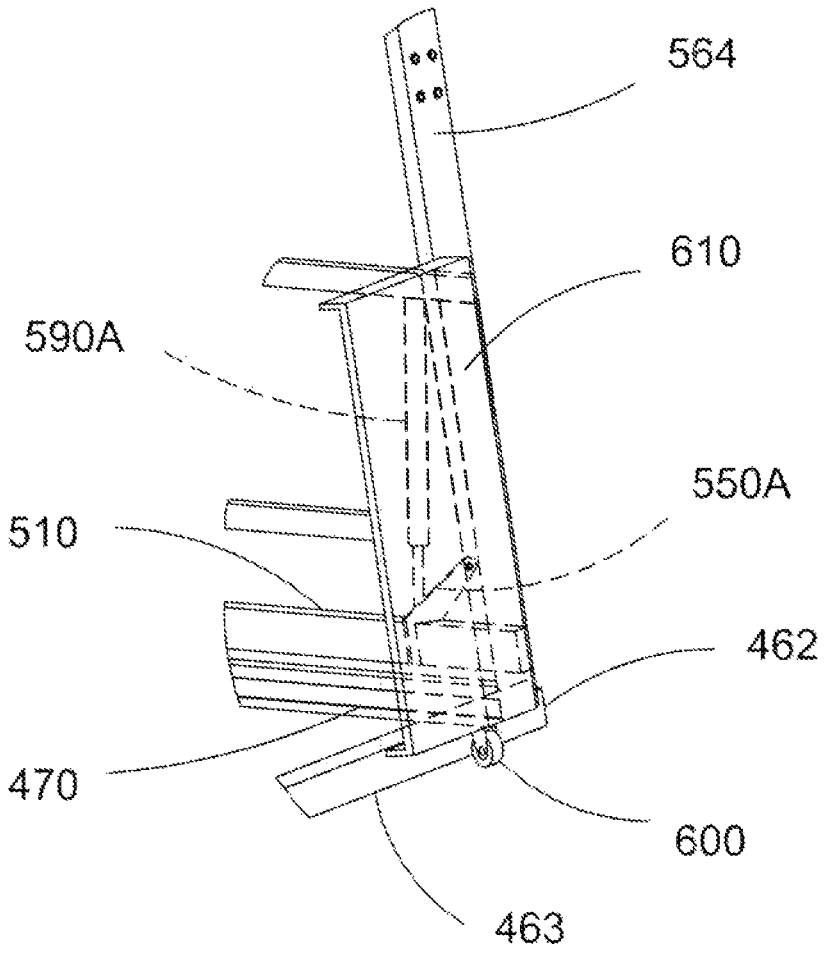
FIG. 21A is a close up view of a portion illustrated in FIG. 21.

The incline plane 565 and incline angle Phi of the mattress support assembly are shown in FIGS. 20 and 21.

Figure 29:
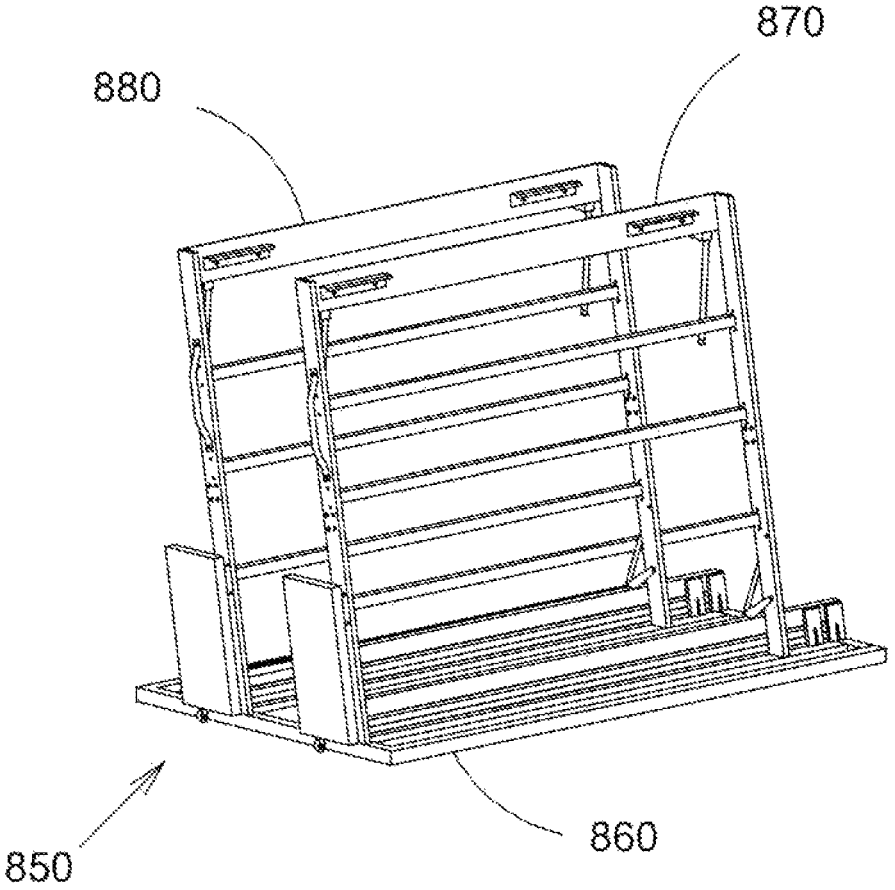
FIG. 29 is a perspective view of a further alternative embodiment of the present invention.
Figure 30:
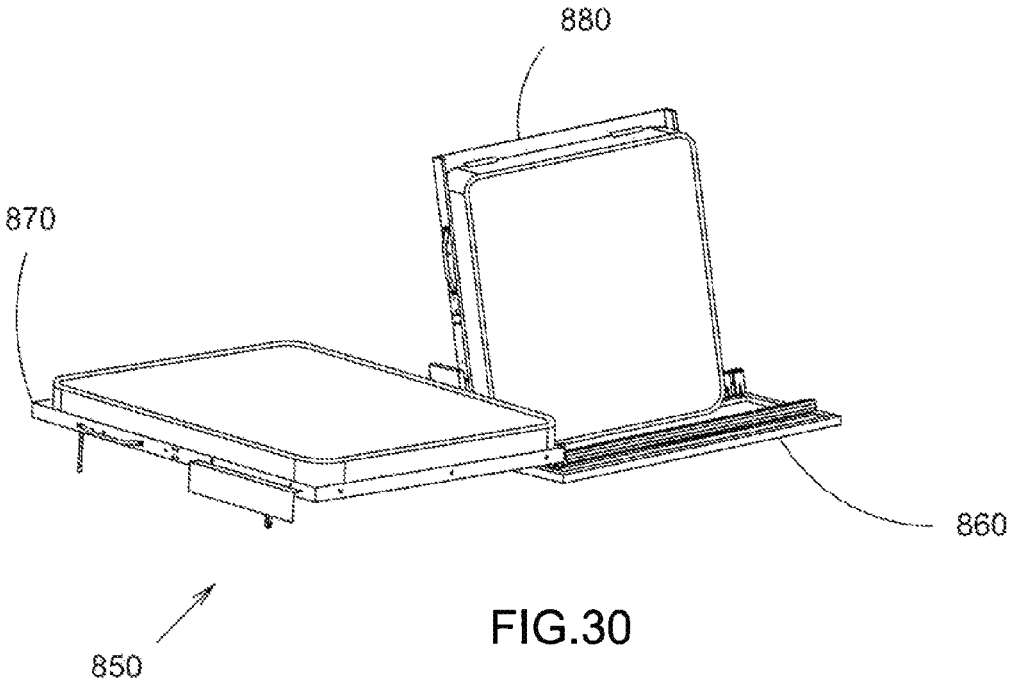
FIG. 30 is an additional perspective view of the embodiment of FIG. 29.

Turning now to FIGS. 29 and 30, it is seen that a further preferred embodiment is illustrated. In this regard, a display rack 850 having a base 860 and display frames 870 and 880 is provided. Display rack 850 is similar to display rack 450, but differs in the size of mattress accommodated. In this embodiment, a larger mattress is accommodated and can be entered from both sides simultaneously. Each display frame 870 and 880 is laterally movable relative the base frame 860 wherein the display frames can be rotated down to a display position to allow users to access the mattress from both sides of the mattress without obstruction.

Figure 31:
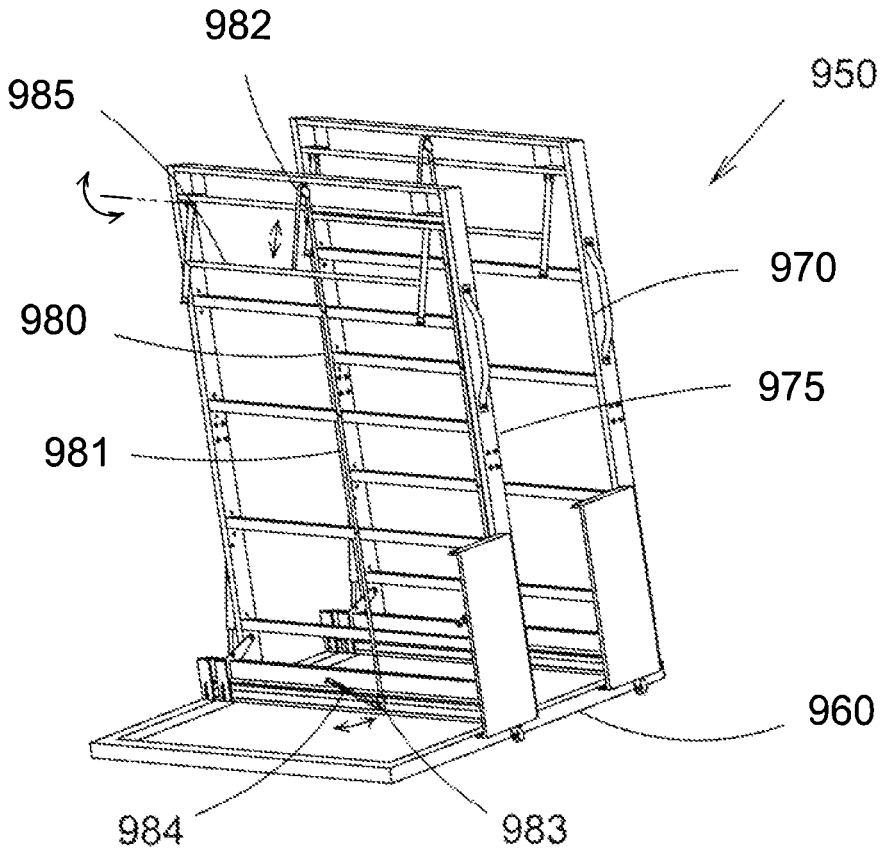
FIG. 31 is a view of an alternative embodiment of a leg assist mechanism.
Figure 32:
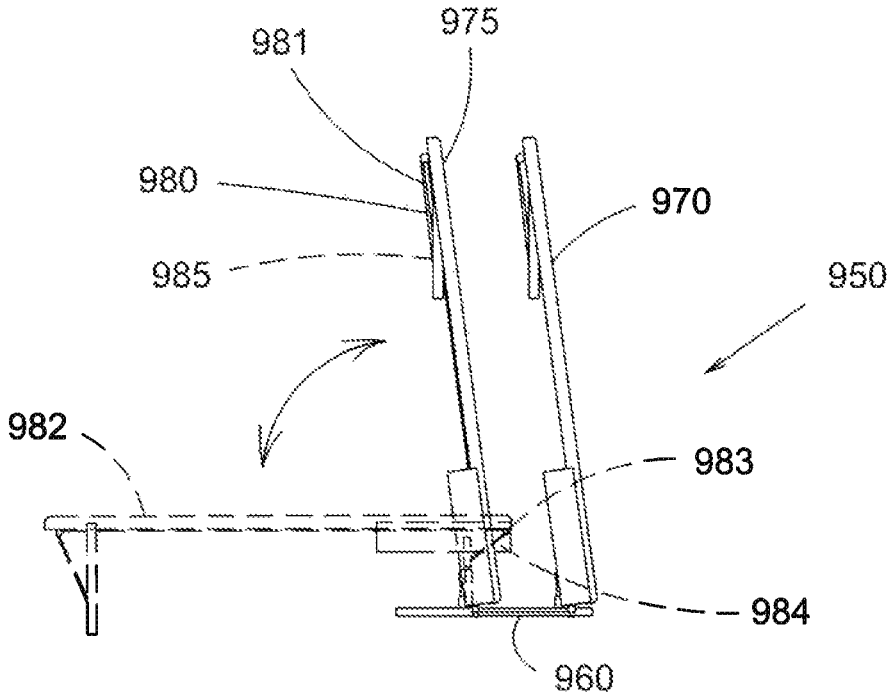
FIG. 32 is an additional view of the leg assist mechanism shown in FIG. 31.

Turning now to FIGS. 31 and 32, it is seen that an alternative mechanical assist 980 is provided for used with a display rack 950. In this regard, the display rack has a base 960 and two display frames 970 and 975 each with a mechanical assist. The mechanical assist 980 has a cable 981, two pulleys 982 and 983, a spring 984 and a crossbar 985. One pulley is at the end of the mattress support assembly. The other pulley is at the other end of the mattress support assembly. The spring 984 is between pulley 983 and the translating bar. Spring 984 is connected to the translating bar and to the cable. The other end of the cable 981 is connected to the crossbar 985, which in turn is connected to the legs. When the display frame is rotated from the upright angle position to the display position, tension is developed within the spring which causes the cable to pull on the crossbar 985. The crossbar 985 rotates the legs to deploy wherein the mechanical mechanism assists the gravity in deploying the legs. The mechanical leg assist operates in addition to the force of gravity. Tension in the cable is released as the display frame is rotated from the display position to the extended position.

Figure 33:
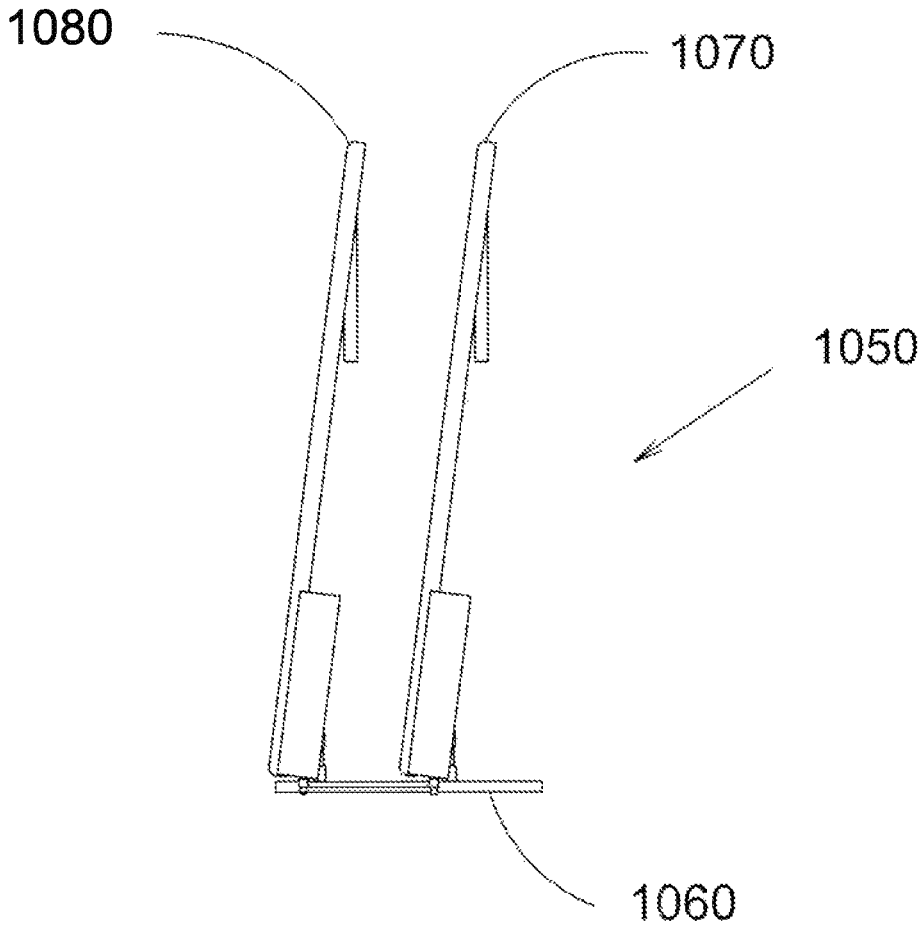
FIG. 33 is a view of an alternative embodiment wherein the display frames can be rotated in a second direction relative the base frame.

Looking now at FIG. 33, it is seen that the present invention can be configured to fall to the right instead of the left. In this regard, a rack 1050 is provided having a base frame 1060 and two display frames 1070 and 1080. Operation of these display frames are similar to one or more of the frames described above except that they have been configured to tilt in the opposite direction. This is accomplished by placing the brackets on the opposite sides of the base frame 1060 components. Advantageously, nearly an identical wall can be used to display mattresses as they racks can be configured to tip away from adjacent walls as desired.

Thus it is apparent that there has been provided, in accordance with the invention, combination storage and display system that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A rack for displaying a mattress comprising:

a base frame; and a display frame, said display frame having a mattress support assembly for supporting the mattress, wherein said mattress support assembly is movable between a storage position, an extended position and a display position upon a translating bar that is movable relative to said base frame, said display frame further comprising an angle determination device comprising a stop bolt having a first end and a second end, wherein said second end engages said translating bar when said mattress support assembly is in said storage position and in said extended position, wherein in said storage position and in said extended position, said mattress support assembly is held in an inclined plane, and in said display position, said mattress support assembly moves relative to said base frame and said stop bolt second end is disengaged from said translating bar.

2. The rack of claim 1 further comprising a mechanical assist operable when said mattress support assembly is moving between said extended position and said display position.

3. The rack of claim 1 wherein an angle from vertical of said inclined plane is between 75 and 85 degrees from a horizontal plane.

* * * * *